United States Patent [19]

Randolph et al.

[11] 4,267,677

[45] May 19, 1981

[54] FILLER INSERT FOR A WALL BASEBOARD ASSEMBLY IN A SPACE DIVIDER SYSTEM

[75] Inventors: Travis M. Randolph, Saugatuck; Thomas J. Newhouse, Grand Rapids, both of Mich.

[73] Assignee: Herman Miller, Inc., Zeeland, Mich.

[21] Appl. No.: 32,944

[22] Filed: Apr. 24, 1979

[51] Int. Cl.[3] ..... E04F 19/04

[52] U.S. Cl. ..... 52/242; 52/716

[58] Field of Search ..... 52/220, 221, 242, 290, 52/716, 241; 339/23

[56] References Cited

U.S. PATENT DOCUMENTS

| | | | |
|---|---|---|---|
| 1,553,965 | 9/1925 | Thomas | 52/716 |
| 1,911,407 | 5/1933 | Thomas | 52/221 |
| 2,132,400 | 10/1938 | Curren | 52/716 |
| 2,138,470 | 11/1938 | Bischof | 52/716 |
| 2,821,754 | 2/1958 | Hillson | 52/716 |
| 4,043,626 | 8/1977 | Propst | 52/242 |

FOREIGN PATENT DOCUMENTS

| | | | |
|---|---|---|---|
| 1159189 | 7/1969 | United Kingdom | 52/590 |

*Primary Examiner*—John E. Murtagh

*Attorney, Agent, or Firm*—Olsen and Stephenson

[57] ABSTRACT

A filler insert for a wall baseboard assembly in a space divider system comprised of a plurality of interconnected upright wall panels. The baseboard assembly includes a plurality of side cover members arranged end to end along the lower edges of the wall panels with the side cover members each having a length substantially equal to the length of its associated wall panel. An opening is formed between adjacent side cover members at the juncture of two interconnected panels. The filler insert comprises a main body positionable in the opening so as to be flush with the adjacent side cover members. Coacting means on the main body and on the side cover members cooperate to maintain the filler insert in the opening.

1 Claim, 3 Drawing Figures

FILLER INSERT FOR A WALL BASEBOARD ASSEMBLY IN A SPACE DIVIDER SYSTEM

BACKGROUND OF THE INVENTION

The present invention relates generally to a space divider system, and more particularly, to a baseboard assembly associated with the space divider system.

Space divider systems comprised of wall panels arranged end to end on the floor and supported by depending leg supports provide the user with great flexibility in arranging and rearranging work areas to meet changing activities. Installing an energy supply and communications system beneath the wall panels has proven to be a convenient and efficient method of providing individual work areas with electricity and communications service. Such under the wall systems have electrical conductors and communications cables positioned below the lower edges of the wall panels. A baseboard assembly consisting of side cover members serves to conceal the components of the system below the wall panels.

A side cover member usually is associated with a single panel and has a length essentially equal to the length of the panel. The wall panels are interconnected by joints which results in an opening being formed between the adjacent side cover members at the juncture between a pair of interconnected wall panels. As a result, a suitable insert must be provided to close the opening to thereby maintain an uninterrupted baseboard construction along the lower edges of the wall panels.

It is the general object of this invention, therefore, to provide a filler insert for a baseboard assembly in a space divider system.

SUMMARY OF THE INVENTION

In accordance with the present invention, a filler insert is provided for a baseboard assembly in a space divider system. The space divider system consists of a plurality of movable wall panels interconnected at their ends by joints. Each wall panel is supported on the floor by depending legs in a position in which its lower edge is spaced above the floor. The space below each wall panel accommodates electrical conductors and communications lines to deliver electricity and provide communication service to the various work areas in the space divider system. The baseboard assembly includes side cover members arranged end to end along the lower edges of the wall panels to conceal the components of the energy supply communications system below the wall panels.

Each wall panel has an associated side cover member whose length substantially equals the length of its associated wall panel. When adjacent wall panels are interconnected, an opening is created between the adjacent side cover members at the juncture of the two panels. The filler insert is interposed between the adjacent side cover members in the opening to provide the baseboard assembly with an essentially uninterrupted outer surface.

The filler insert consists of a main body having a cross sectional shape similar to the cross sectional shape of the side cover members. Flange portions extend from the opposite ends of the main body and are spaced rearwardly from its front surface. The offset flange portions engage the rear surfaces of the cover members when the filler insert is positioned in the opening at the juncture of the two panels to restrain forward movement of the insert relative to the side cover members. The main body also abuts against the wall panels so as to be restrained from rearward movement. The filler insert is formed of resilient material such as plastic. An opening can readily be cut in the main body providing access to the electrical circuit or the communications lines.

Further objects, features and advantages of the present invention will become apparent from a consideration of the following description when taken in connection with the appended claims and the accompanying drawing in which:

Figure 1:
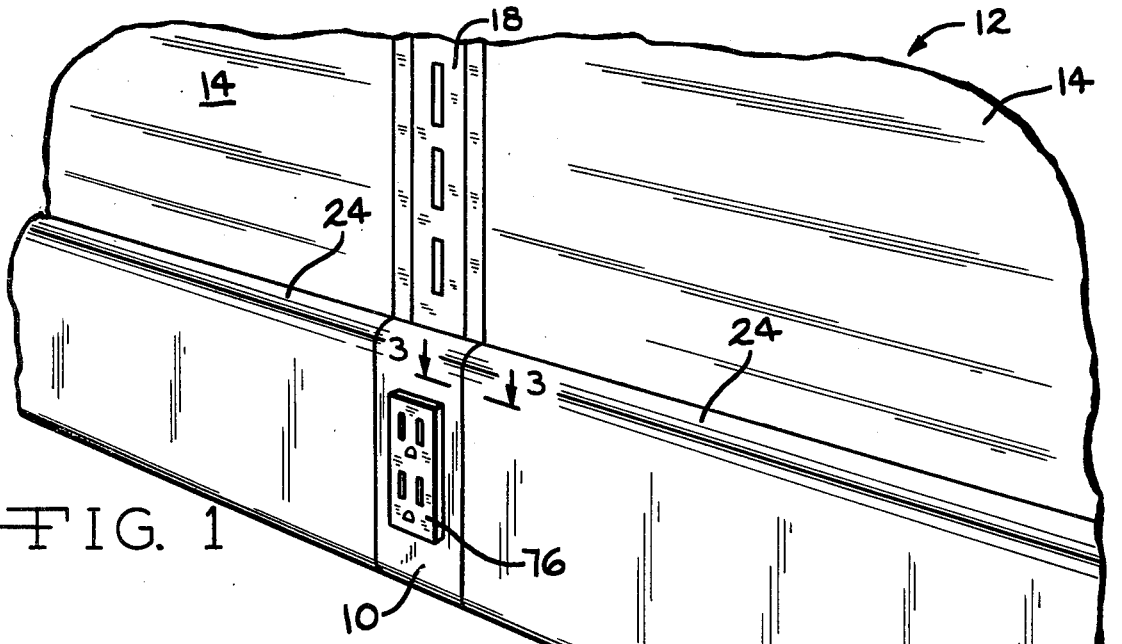
FIG. 1 is a perspective view illustrating the filler insert of this invention interposed between a pair of adjacent side cover members.
Figure 2:
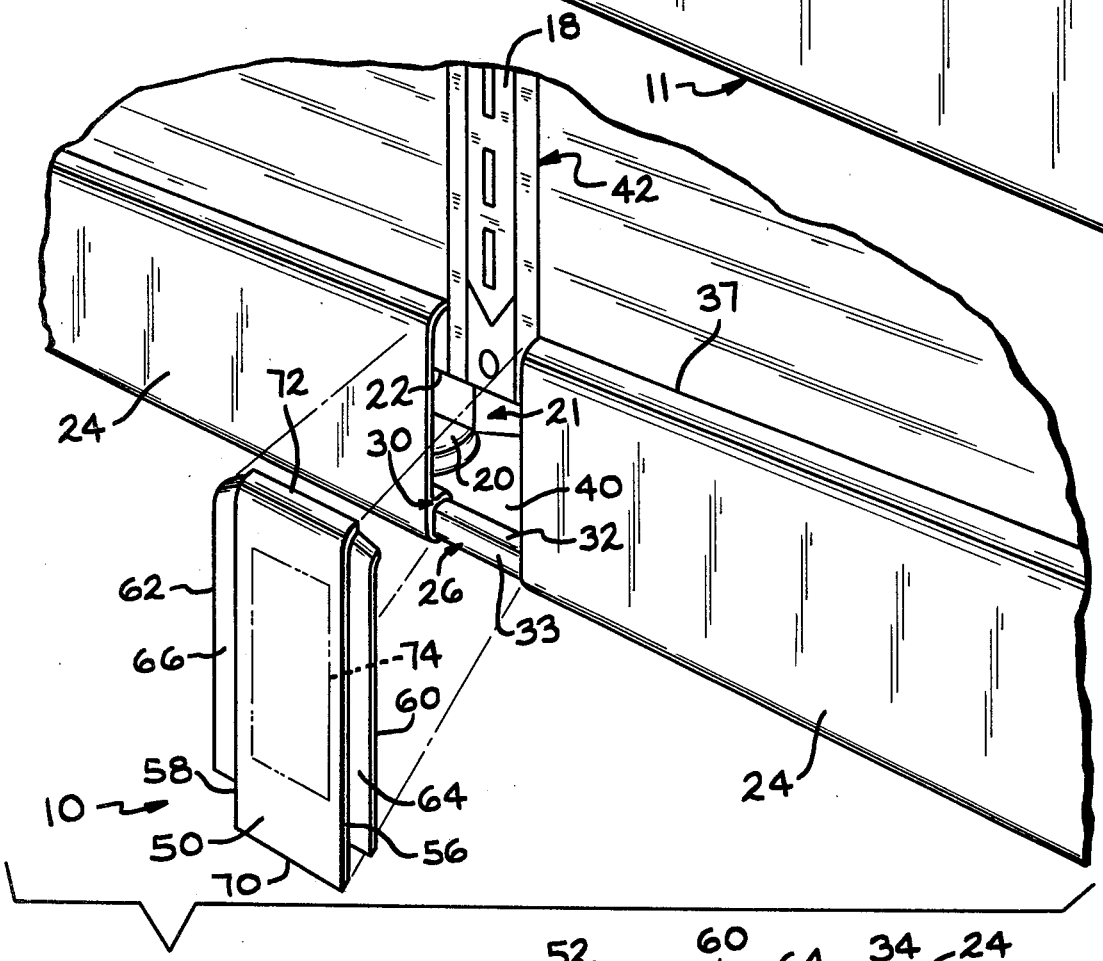
FIG. 2 is a perspective view of a space divider system like the system shown in FIG. 1 but illustrating the filler insert of this invention displaced from the opening between adjacent side cover members.

Referring to the drawing, the filler insert of this invention, indicated generally at 10, is shown in FIG. 1 disposed in a baseboard assembly 11 which forms a portion of a space divider system 12. The space divider system 12 consists of a plurality of upright wall panels 14 arranged end to end on a floor 16. The wall panels 14 are connected together at their adjacent ends by joints 18 such as those disclosed in U.S. Pat. No. 3,517,467. Each wall panel 15 has downwardly extending leg supports 20 which support the wall panel 14 in a position in which its lower edge 22 is spaced above the floor 16. The elevated lower edge 22 of each panel 14 provides a space 21 below the panel 14 so that an under the wall energy supply and communications system 23 can be installed to run beneath the lower edges 22 of the wall panels 24. Accordingly, electricity and communications service are available throughout the space divider system 12 to accomodate the energy and communications requirements of the various work areas within the space divider system 12.

The baseboard assembly 11 includes side cover members 24 mounted on tracks 26 which are positioned on the floor 16 and which support the wall panels 14. The side cover members 24 extend between the floor 16 and the wall panels 14 to conceal the space 21. Each side cover member 24 includes resilient grip portions 30 which straddle and grip a longitudinally extending rail 32 formed integral with the track 26 to maintain the side cover members 24 in upright positions. A parallel rail (not shown) is positioned on the opposite side of the track 26 to support a side cover member 24.

Figure 3:
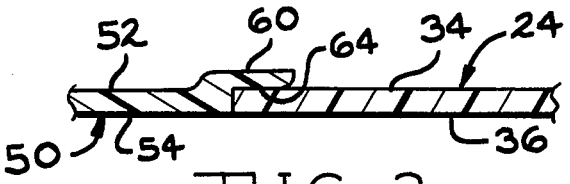
FIG. 3 is a sectional view of the filler insert and an adjacent side cover member taken substantially from line 2—2 in FIG. 1.

Each side cover member 24, as seen in FIG. 3, includes rear surface 34 and an outer or front surface 36 and terminates in an upper inwardly curved portion 37 that abuts against the wall panel 14 above and adjacent to its lower edge 22 when the side cover member 24 is mounted on the rail 32. Usually the length of each cover member 24 is substantially equal to the length of its associated panel 14. When the wall panels 14 are arranged end to end and connected by the joints 18, however, an opening or gap 40 is formed between the ends of the adjacent side cover members 24 at the juncture 42 between the interconnected wall panels 14, the opening 40 being caused by the joint 18 being disposed between the adjacent wall panels 14.

The filler insert 10 comprises a main body 50 having a cross sectional shape similar to the cross sectional shape of the side cover members 24. The main body 50 has a rear surface 52, a front surface 54, and ends 56 and 58. The length of the main body 50 between its ends 56 and 58 is substantially equal to the span of the opening 40 between the adjacent ends of the side cover members 24. Offset flange portions 60 and 62 are formed integral with and extend lengthwise from the main body 50 at the ends 56 and 58 and are spaced rearwardly from the front surface 54 of the body 50. When the insert 10 is positioned in the opening 40, the flange portions 60 and 62 are positioned behind and in engagement with the rear surfaces 34 of the adjacent side cover members 24. The distance between the front surface 64 of the flange 60 and the front surface 66 of the flange 62 relative to the front surface 54 of the main body is sufficient to position the front surface 54 of the insert 10 flush with the front surfaces 36 of the side cover members 24 when the flanges 60 and 62 engage the rear surfaces 34 of the side cover members 24. The flange portions 60 and 62 thus perform a dual function of locating the front surface 54 of the insert 10 flush with the front surfaces 36 of the adjacent side cover members 24 and preventing the forward movement of the insert 10 relative to the side cover member 24.

The main body 50 has a lower extension or portion 70 which abuts against the outside edge 33 of the rail 32 and an upper inwardly curved portion 72 which engages the joint 18 when the filler insert 10 is positioned in the opening 40. The portions 70 and 72 on the body 50 serve to prevent the rearward movement of the filler insert 10 from its interposed position between the adjacent side cover members 24.

The main body 50 is formed of plastic or similar resilient material which readily can be cut. The installer of the space divider system 12 can cut an opening 74 in the insert 10. A receptacle outlet 76 then can be positioned in the opening 74 and connected to the electrical circuit beneath the wall panels 14. If a receptacle outlet 76 is not needed at a particular juncture 42, the filler insert 10 is positioned in the opening 40 without any opening being cut through the body 50 of the insert.

From the above description, it can be seen that an improved insert is provided for filling any openings between adjacent side cover members in the space divider system. The filler insert is economical and easily installed and removed from an opening between adjacent side cover members.

It is claimed:

1. In a baseboard assembly positioned along the lower edge of a wall unit and comprised of a plurality of upright cover members arranged end to end and support means mounting said cover members in said upright position along said wall unit, each of said cover members having a front surface and a rear surface facing said wall unit, at least a pair of adjacent ones of said cover members being spaced apart to form an opening between the adjacent ends thereof, a removable filler section positioned in said opening and spanning substantially the entire distance between said adjacent ends, said filler section comprising a main body having longitudinally spaced apart opposite ends and an outer surface generally conforming with the outer surfaces of said adjacent cover members, and coacting means maintaining said filler section in an interposed position in said opening such that the outer surface of said main body is substantially flush with the outer surfaces of said pair of adjacent cover members, said coacting means comprising flange portions extending longitudinally from said main body at the opposite ends thereof, said flange portions being offset rearwardly with respect to said main body and engaging the rear surfaces of said pair of adjacent cover members to restrain forward movement of said filler section from said interposed position, said main body having an upper portion in front of and abutting said wall unit and a lower portion in front of and abutting said support means to restrain rearward movement of said filler section from said interposed position, said flange portions and said abutting portions coacting with said wall unit, said support means, and said side cover members to maintain said filler section in said interposed position, said filler section being releasable forwardly by removal of one or both of said adjacent cover members from said support means.

* * * * *